US009121285B2

(12) United States Patent
Ristau

(10) Patent No.: US 9,121,285 B2
(45) Date of Patent: Sep. 1, 2015

(54) TURBINE AND METHOD FOR REDUCING SHOCK LOSSES IN A TURBINE

(75) Inventor: Neil Ristau, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 569 days.

(21) Appl. No.: 13/479,935

(22) Filed: May 24, 2012

(65) Prior Publication Data

US 2013/0315726 A1 Nov. 28, 2013

(51) Int. Cl.
*F01D 1/04* (2006.01)
*F01D 5/14* (2006.01)

(52) U.S. Cl.
CPC ..... *F01D 5/141* (2013.01); *F01D 5/145* (2013.01); *F05D 2240/302* (2013.01); *F05D 2240/307* (2013.01); *Y10T 29/49238* (2015.01)

(58) Field of Classification Search
CPC ..... F01D 25/06
See application file for complete search history.

(56) References Cited

U.S. PATENT DOCUMENTS 3,989,406 A * 11/1976 Bliss ..... 415/1
4,726,737 A 2/1988 Weingold et al.
5,031,313 A 7/1991 Blair et al.
5,167,489 A 12/1992 Wadia et al.
5,525,038 A * 6/1996 Sharma et al. ..... 416/238
5,642,985 A * 7/1997 Spear et al. ..... 416/238
5,839,267 A 11/1998 Schonewald et al.
6,195,983 B1 * 3/2001 Wadia et al. ..... 60/226.1
6,338,609 B1 1/2002 Decker et al.
8,133,012 B2 * 3/2012 Nagai et al. ..... 415/150

FOREIGN PATENT DOCUMENTS

DE 1903642 A1 8/1970

OTHER PUBLICATIONS

Search Report and Written Opinion from EP Application No. 13167581.1 dated Jul. 26, 2013.

* cited by examiner

*Primary Examiner* — Dwayne J White
*Assistant Examiner* — Justin Seabe
(74) *Attorney, Agent, or Firm* — Dority & Manning, PA

(57) ABSTRACT

A turbine includes a rotor and a casing that circumferentially surrounds at least a portion of the rotor. The rotor and the casing at least partially define a gas path through the turbine. A last stage of rotating blades is circumferentially arranged around the rotor and includes a downstream swept portion radially outward from the rotor. A method for reducing shock losses in a turbine includes removing a last stage of rotating blades circumferentially arranged around a rotor and replacing the last stage of rotating blades with rotating blades having a downstream swept portion radially outward from the rotor.

13 Claims, 3 Drawing Sheets

TURBINE AND METHOD FOR REDUCING SHOCK LOSSES IN A TURBINE

FEDERAL RESEARCH STATEMENT

This invention was made with Government support under Contract No. DE-FC26-05NT42643, awarded by the Department of Energy. The Government has certain rights in the invention.

FIELD OF THE INVENTION

The present disclosure generally involves a turbine and a method for reducing shock loss in a turbine.

BACKGROUND OF THE INVENTION

Turbines are widely used in a variety of aviation, industrial, and power generation applications to perform work. Each turbine generally includes alternating stages of peripherally mounted stator vanes and axially mounted rotating blades. The stator vanes may be attached to a stationary component such as a casing that surrounds the turbine, while the rotating blades may be attached to a rotor located along an axial centerline of the turbine. The stator vanes and rotating blades each have an airfoil shape, with a concave pressure side, a convex suction side, and leading and trailing edges. In addition, conventional rotating blades are mechanically stacked such that the center of gravity of each section coincides axially and/or tangentially with an airfoil hub center of gravity. A compressed working fluid, such as steam, combustion gases, or air, flows along a gas path through the turbine. The stator vanes accelerate and direct the compressed working fluid onto the subsequent stage of rotating blades to impart motion to the rotating blades, thus turning the rotor and performing work.

Various conditions may affect the maximum power output of the turbine. For example, colder ambient temperatures generally increase the differential pressure of the compressed working fluid across the turbine. As the differential pressure of the compressed working fluid across the turbine increases, the velocity of the compressed working fluid over the suction side of the rotating blade increases, creating considerable shock waves and corresponding shock losses at the trailing edge of the rotating blades. At a sufficient differential pressure, the shock waves and corresponding shock losses at the trailing edge of the rotating blades may prevent the rotating blades from increasing the amount of work being extracted from the compressed working fluid. At a sufficient differential pressure, the shock waves become tangential to the trailing edge, creating a condition known as limit load. The strong shock now goes from the trailing edge of one airfoil to the trailing edge of the adjacent airfoil. The resultant shock losses may prevent the rotating blades from increasing the amount of work being extracted from the compressed working fluid as the maximum tangential force is reached. If the pressure ratio increases beyond the limit load, a drastic increase in loss occurs. As a result, the maximum power output of the turbine may be limited by colder ambient temperatures.

Various systems and methods have been developed to reduce the shock losses across the rotating blades. For example, the geometric shape of the airfoil and the size of the gas path directly affect the velocity of the compressed working fluid, and thus the shock losses, across the rotating blades. However, the geometric shape of the airfoil can only reduce the shock losses to a certain extent. In addition, the size of the gas path is generally constrained by other design limits and is generally fixed after manufacture of the turbine. Therefore, an improved turbine and method for reducing shock losses in the turbine would be useful, especially for uprates, where an increase in flow and hence Mach number exists.

BRIEF DESCRIPTION OF THE INVENTION

Aspects and advantages of the invention are set forth below in the following description, or may be obvious from the description, or may be learned through practice of the invention.

One embodiment of the present invention is a turbine that includes a rotor and a casing that circumferentially surrounds at least a portion of the rotor. The rotor and the casing at least partially define a gas path through the turbine. A last stage of rotating blades is circumferentially arranged around the rotor and includes a downstream swept portion radially outward from the rotor.

Another embodiment of the present invention is a turbine that includes a rotor, a first stage of rotating blades circumferentially arranged around the rotor, and a stage of stator vanes downstream from the first stage of rotating blades. A last stage of rotating blades is downstream from the stage of stator vanes and includes a downstream swept portion radially outward from the rotor.

The present invention may also include a method for reducing shock losses in a turbine. The method includes removing a last stage of rotating blades circumferentially arranged around a rotor and replacing the last stage of rotating blades with rotating blades having a downstream swept portion radially outward from the rotor.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
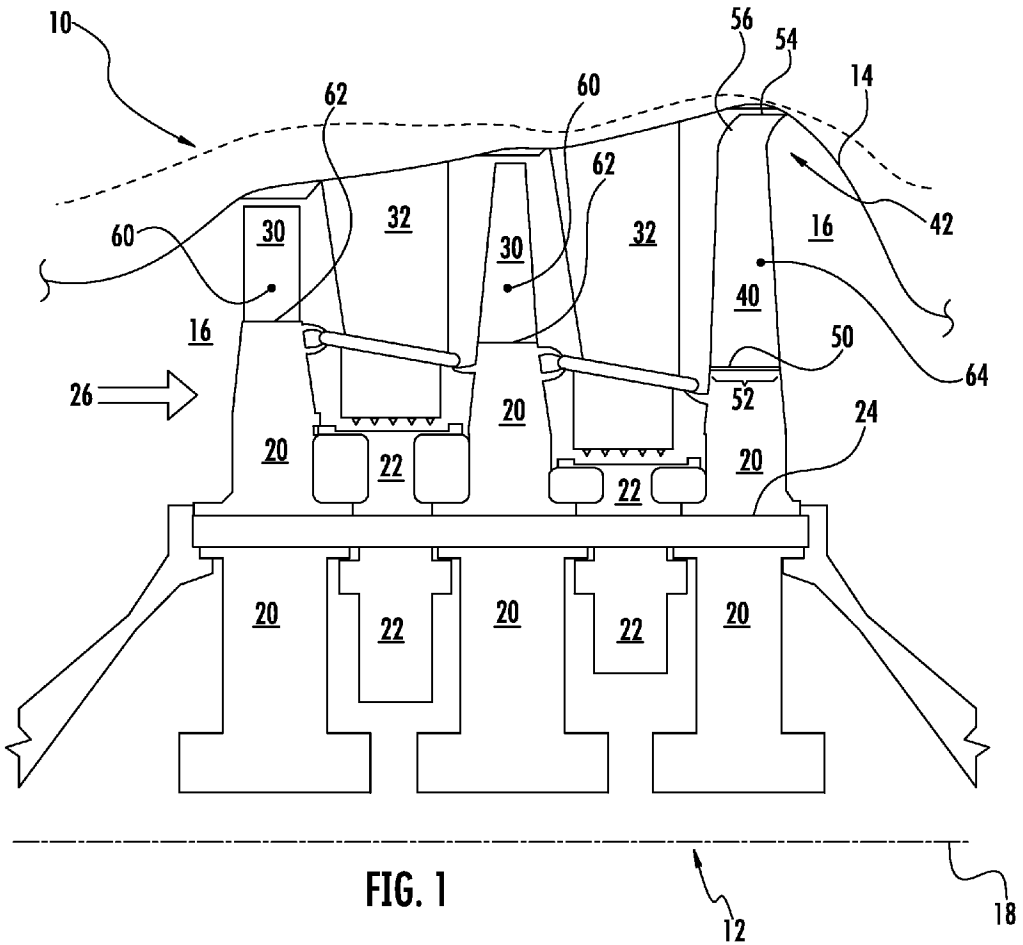
FIG. 1 is a simplified side cross-section view of an exemplary turbine according to a first embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream"

refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a turbine and a method for reducing shock losses in a turbine. The turbine generally includes alternating stages of stator vanes attached to a casing and rotating blades circumferentially arranged around a rotor. The stator vanes, rotating blades, casing, and rotor generally define a gas path through the turbine. The last stage of rotating blades includes a downstream swept portion that effectively increases the turbine exit annulus area. As a result, the downstream swept portion may reduce the shock strength and corresponding shock losses in the turbine. Although exemplary embodiments of the present invention will be described generally in the context of a turbine incorporated into a gas turbine for purposes of illustration, one of ordinary skill in the art will readily appreciate that embodiments of the present invention may be applied to any turbine unless specifically recited in the claims.

Figure 2:
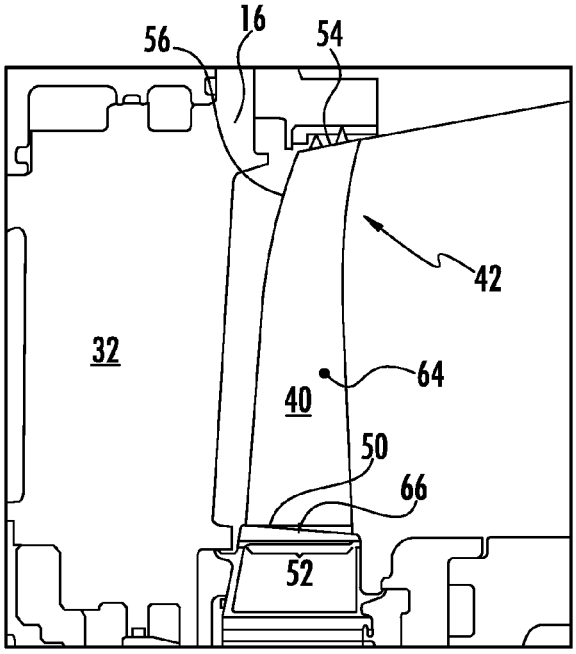
FIG. 2 is a simplified side cross-section view of an exemplary turbine according to a second embodiment of the present invention.
Figure 3:
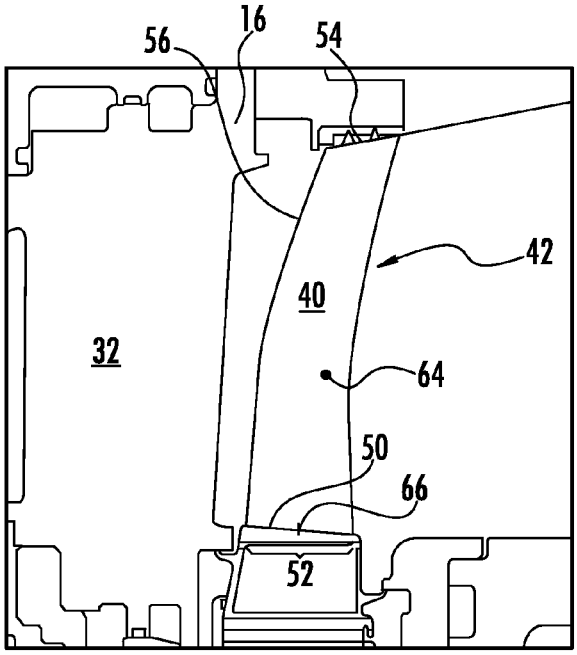
FIG. 3 a simplified side cross-section view of an exemplary turbine according to a third embodiment of the present invention.

FIGS. 1-3 provide simplified side cross-section views of exemplary turbines 10 according to various embodiments of the present invention. As shown in FIGS. 1-3, the turbine 10 generally includes a rotor 12 and a casing 14 that at least partially define a gas path 16. The rotor 12 is generally aligned with an axial centerline 18 of the turbine 10 and may be connected to a generator, a compressor, or another machine to produce work. The rotor 12 may include alternating sections of rotor wheels 20 and rotor spacers 22 connected together by a bolt 24 to rotate in unison. The casing 14 circumferentially at least a portion of the rotor 12 to contain a compressed working fluid 26 flowing through the gas path 16. The compressed working fluid 26 may include, for example, combustion gases, compressed air, saturated steam, unsaturated steam, or a combination thereof.

As shown in FIGS. 1-3, the turbine 10 further includes alternating stages of rotating blades 30 and stator vanes 32 that extend radially between the rotor and the casing. The rotating blades 30 are circumferentially arranged around the rotor 12 and may be connected to the rotor wheels 20 using various means. In contrast, the stator vanes 32 may be peripherally arranged around the inside of the casing 14 opposite from the rotor spacers 22. The rotating blades 30 and stator vanes 32 generally have an airfoil shape, with a concave pressure side, a convex suction side, and leading and trailing edges, as is known in the art. The compressed working fluid 26 flows along the gas path 16 through the turbine 10 from left to right as shown in FIGS. 1-3. As the compressed working fluid 26 passes over the first stage of rotating blades 30, the compressed working fluid expands, causing the rotating blades 30, rotor wheels 20, rotor spacers 22, bolt 24, and rotor 12 to rotate. The compressed working fluid 26 then flows across the next stage of stator vanes 32 which accelerate and redirect the compressed working fluid 26 to the next stage of rotating blades 30, and the process repeats for the following stages. In the exemplary embodiments shown in FIGS. 1-3, the turbine 10 has two stages of stator vanes 32 between three stages of rotating blades 30; however, one of ordinary skill in the art will readily appreciate that the number of stages of rotating blades 30 and stator vanes 32 is not a limitation of the present invention unless specifically recited in the claims.

As shown in FIGS. 1-3, the turbine 10 includes a last stage of rotating blades 40 having a downstream swept portion 42 radially outward from the rotor 12. As used herein, the term "last" refers to the stage of rotating blades 40 that is downstream from all other stages of rotating blades 30 inside the turbine 10. As a result, the turbine 10 may have multiple stages of rotating blades 30; however, the turbine 10 can only have a single last stage of rotating blades 40 that is downstream from all other stages of rotating blades 30 inside the turbine 10. In addition, as used herein, the term "downstream swept" refers to the gradual curvature or stepped change in the rotating blades 40 in the downstream direction of the gas path 16 as the rotating blades 40 extend radially outward from the rotor 12. The location and magnitude of the downstream swept portion 42 may vary according to various metrics as well as the particular design needs for the turbine 10, and embodiments of the present invention are not limited to a specific location and/or magnitude of the downstream swept portion 42 unless specifically recited in the claims.

The last stage of rotating blades 40 may begin to sweep downstream at any point radially outward from the rotor 12. For example, in the particular embodiment shown in FIG. 1, the downstream swept portion 42 begins at approximately 90% along the radial length of the rotating blades 40. In contrast, the downstream swept portion 42 begins at approximately 50% and 25% along the radial length of the rotating blades 40 in the embodiments shown in FIGS. 2 and 3, respectively. Inasmuch as the downstream swept portion 42 virtually increases the effective turbine exit annulus area of the gas path 16, commencing the downstream swept portion 42 closer to the rotor 12 results in a larger virtual increase in the effective annuls area of the gas path 16. Computational fluid dynamic models indicate that the larger effective annulus area of the gas path 16 results in lower compressed working fluid 26 Mach number across the downstream swept portion 42, producing a corresponding decrease in the shock waves and shock losses across the rotating blades 40.

The amount of downstream sweep in the downstream swept portion 42 is yet another variable unique to various embodiments with the scope of the present invention. For example, in the embodiments shown in FIGS. 1-3, the rotor 12 may have an outer surface 50, and each rotating blade 40 in the last stage may have an axial length 52, a radial tip 54, and a leading edge 56 that extends radially from the outer surface 50 of the rotor 12 to the radial tip 54. The beginning point and curvature of the downstream swept portion 42 determine the amount of downstream sweep in the downstream swept portion 42. For example, in the embodiment shown in FIG. 1 in which the downstream swept portion 42 begins at approximately 90% along the radial length of the rotating blades 40, the leading edge 56 at the radial tip 54 may be axially downstream from a conventional center of gravity stacked tip section leading edge by approximately 5%. In comparison, the downstream swept portion 42 shown in FIGS. 2 and 3 begins closer to the outer surface 50 of the rotor. As a result, the leading edge 56 at the radial tip 54 may be axially downstream from the conventional stack leading edge by approximately 10%, 15%, or more, as shown in FIGS. 2 and 3.

The location, length, and/or amount of downstream sweep of the downstream swept portion 42 may also influence the location of the center of gravity for the rotating blades 40. For example, as best seen in FIG. 1, the rotating blades 30 upstream from the last stage of rotating blades 40 are conventionally radially aligned so that a center of gravity 60 for each rotating blade 30 coincides with the center of gravity of the hub 62 or lowest section of the airfoil. In contrast, the downstream swept portion 42 of the last stage of rotating blades 40 shifts the center of gravity 64 for the rotating blades 40 downstream from the axial hub center of gravity point 66, as shown in FIG. 1. In FIGS. 2 and 3, where the downstream swept portion 42 begins closer to the rotor 12 and is therefore longer, the center of gravity 64 for the rotating blades 40 may be downstream from a point 60%, 70%, or further along the axial length 52 of the rotating blades 40.

Figure 4:
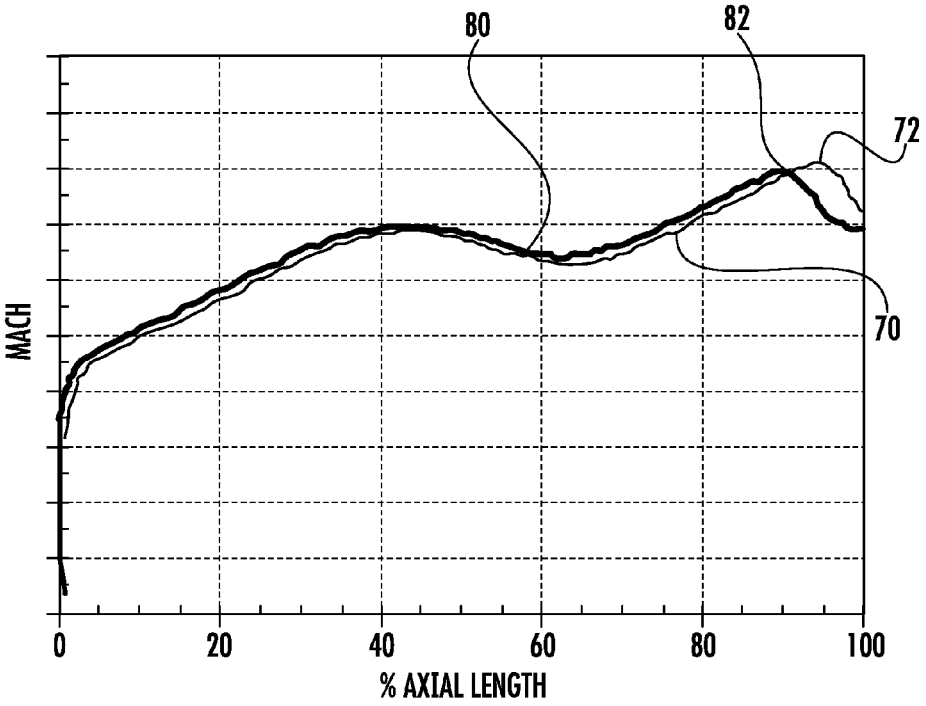
FIG. 4 is exemplary graphs of isentropic Mach number on the suction surface of the rotating blades at various axial positions.

Computational fluid dynamics indicate that the downstream swept portion 42 in the embodiments shown in FIGS. 1-3 may have one or more effects on the compressed working fluid 26 flowing through the gas path 16. For example, FIG. 4 provides exemplary Mach number profiles of the compressed working fluid 26 across the axial length 52 of conventional rotating blades 30 in the last stage compared to the last stage of rotating blades 40 shown in FIG. 1. As shown, the Mach profile 70 for the conventional rotating blades 30 indicates a maximum Mach 72 approximately coincident with the trailing edge of the rotating blade 30. This maximum Mach 72 at the trailing edge results in shock waves and corresponding shock losses that are approximately normal to the trailing edge. In contrast, the Mach profile 80 for the rotating blades 40 with the downstream swept portion 42 shown in FIG. 1 indicates a reduced maximum Mach 82 further upstream from the trailing edge of the rotating blade 40. The reduced maximum Mach 82 results in smaller shock waves and correspondingly smaller shock losses compared to the conventional rotating blade 30. In addition, the shift in the maximum Mach 82 away from the trailing edge of the rotating blade 40 results in shock waves that are oblique to the trailing edge, further reducing the associated shock losses.

The various embodiments shown and described with respect to FIGS. 1-3 may be incorporated into new turbine 10 designs or incorporated into existing turbine 10 designs during planned or unplanned outages to reduce shock losses in the turbine 10. For example, for existing turbine 10 designs, conventional rotating blades 30 in the last stage may be removed and replaced with the rotating blades 40 having the downstream swept portion 42 as shown in FIGS. 1-3. The location, length, and amount of the downstream sweep may be specifically tailored according to the particular location and anticipated environmental conditions for the turbine 10 being modified. As a result, existing turbines 10 may be suitably retrofitted to accommodate higher compressed working fluid 26 velocities through the turbine 10.

This written description uses examples to disclose the invention, including the best mode, and also to enable any person skilled in the art to practice the invention, including making and using any systems or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A turbine comprising:

a. a rotor;

b. a casing circumferentially surrounding at least a portion of the rotor, wherein the rotor and the casing at least partially define a gas path through the turbine;

c. a last stage of rotating blades circumferentially arranged around the rotor, wherein each rotating blade of the last stage of rotating blades includes a downstream swept portion defined along a radial span of the rotating blade, wherein the downstream swept portion extends from a point defined along the span that is radially outward from the rotor to a tip of the rotating blade, wherein a radial length of the rotating blade continuously increases along a chord line of the rotating blade from a leading edge portion of the rotating blade to a trailing edge portion of the rotating blade.

2. The turbine as in claim 1, wherein the downstream swept portion of each rotating blade of the last stage of rotating blades extends across at least 50% of the span of the rotating blade.

3. The turbine as in claim 1, wherein the downstream swept portion of each rotating blade of the last stage of rotating blades begins at a point that is at least 90% of the span of the rotating blade from the rotor.

4. The turbine as in claim 1, wherein each rotating blade in the last stage of rotating blades has a center of gravity axially downstream from a hub center of gravity.

5. The turbine as in claim 1, wherein each rotating blade of the last stage of rotating blades has a leading edge at the rotor and a center of gravity axially downstream from the leading edge by at least 60% of a cord length of the rotating blade.

6. A turbine comprising:

a. a rotor;

b. a first stage of rotating blades circumferentially arranged around the rotor;

c. a stage of stator vanes downstream from the first stage of rotating blades;

d. a last stage of rotating blades downstream from the stage of stator vanes, wherein each rotating blade of the last stage of rotating blades includes a downstream swept portion defined along a radial span of the rotating blade, wherein the downstream swept portion extends from a point defined along the span that is radially outward from the rotor to a tip of the rotating blade, wherein a radial length of the rotating blade continuously increases along a chord line of the rotating blade from a leading edge portion of the rotating blade to a trailing edge portion of the rotating blade.

7. The turbine as in claim 6, wherein the downstream swept portion of each rotating blade of the last stage of rotating blades extends across at least 50% of the span of the rotating blade.

8. The turbine as in claim 6, wherein the downstream swept portion of each rotating blade of the last stage of rotating blades begins at a point that is at least 90% of the span of the rotating blade from the rotor.

9. The turbine as in claim 6, wherein each rotating blade in the last stage of rotating blades has a center of gravity axially downstream from a hub center of gravity.

10. The turbine as in claim 6, wherein each rotating blade in the last stage of rotating blades has a leading edge at the rotor and a center of gravity axially downstream from the leading edge by at least 60% of a cord length of the rotating blade.

11. A method for reducing shock losses in a turbine, comprising:

a. removing a last stage of rotating blades circumferentially arranged around a rotor;

b. replacing the last stage of rotating blades with rotating blades having a downstream swept portion radially outward from the rotor, wherein the downstream swept portion extends from a point defined along the span that is radially outward from the rotor to a tip of the rotating blade, wherein a radial length of the rotating blade continuously increases along a chord line of the rotating blade from a leading edge portion of the rotating blade to a trailing edge portion of the rotating blade.

12. The method as in claim 11, further comprising replacing the last stage of rotating blades with rotating blades having a downstream swept portion, wherein the downstream swept portion of each rotating blade of the last stage of rotating blades begins at a point that is at least 90% of a span of the rotating blade from the rotor.

13. The method as in claim 11, further comprising replacing the last stage of rotating blades with rotating blades having an axial length and a center of gravity, and the center of gravity is axially downstream from a hub center of gravity.

* * * * *